US012202588B2

(12) United States Patent
Nuutinen

(10) Patent No.: US 12,202,588 B2
(45) Date of Patent: Jan. 21, 2025

(54) METHOD OF CONTROLLING PROPULSION OF MARINE VEHICLE

(71) Applicant: ABB Schweiz AG, Baden (CH)

(72) Inventor: Mika Nuutinen, Helsinki (FI)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 18/603,459

(22) Filed: Mar. 13, 2024

(65) Prior Publication Data

US 2024/0326967 A1 Oct. 3, 2024

(30) Foreign Application Priority Data

Apr. 3, 2023 (EP) ..... 23166286

(51) Int. Cl.

| | |
|---|---|
| ***B63H 1/10*** | (2006.01) |
| ***B63H 3/10*** | (2006.01) |
| *B63H 3/00* | (2006.01) |

(52) U.S. Cl.

CPC ..... *B63H 3/10* (2013.01); *B63H 1/10* (2013.01); *B63H 2001/105* (2013.01); *B63H 3/002* (2013.01)

(58) Field of Classification Search

CPC . B63H 3/10; B63H 1/10; B63H 3/002; B63H 2001/105

See application file for complete search history.

(56) References Cited

U.S. PATENT DOCUMENTS

| | | | | |
|---|---|---|---|---|
| 3,704,961 | A | 12/1972 | Fork et al. | |
| 4,752,258 | A | 6/1988 | Hochleitner et al. | |
| 2022/0009300 | A1* | 1/2022 | Benedict | B63H 3/00 |
| 2023/0234690 | A1* | 7/2023 | Nuutinen | B63B 1/28 701/21 |

FOREIGN PATENT DOCUMENTS

| | | | |
|---|---|---|---|
| CN | 107187570 | B | 4/2019 |
| WO | 2021249644 | A1 | 12/2021 |
| WO | 2021249645 | A1 | 12/2021 |

OTHER PUBLICATIONS

European Search Report; Application No. EP23166286; Completed: Sep. 20, 2023; 3 Pages.

* cited by examiner

*Primary Examiner* — Aaron R Eastman
(74) *Attorney, Agent, or Firm* — Whitmyer IP Group LLC

(57) ABSTRACT

A method for controlling a propulsion system of a marine vehicle is disclosed. A controller forms data on pitch angles of at least two foils, which are in a rotatable manner attached with a foil wheel, based on at least an angularly variable eccentricity of the at least two foils and an angle of rotation of the foil wheel. The variable eccentricity is limited at a portion of the angle of rotation of the foil wheel. An actuator arrangement receives the data from the controller and sets the at least two foils at the pitch angles based on the data.

20 Claims, 8 Drawing Sheets

METHOD OF CONTROLLING PROPULSION OF MARINE VEHICLE

TECHNICAL FIELD

The invention relates to a method of controlling a propulsion system of a marine vehicle.

BACKGROUND

A marine vehicle may move with respect to water around it with thrust from a propulsion system, which includes one or more rotating foil wheels with foils that extend perpendicularly from the wheel. A foil wheel propulsion system generates thrust by a combined action of a rotation of a fixed point around a centre and an oscillation of the foils. With individual foil pitch control, a typical propulsion system works with a trochoidal pitch angle optimal for full speed torque loads. However, such propulsion system with realistically limited foil motor torque may not be optimal in bollard pull conditions.

Hence, it would be beneficial to find a pitch angle function that has an improved bollard pull thrust with a propulsion system of realistically limited foil motor torque.

SUMMARY

According to an aspect, there is provided the subject-matter of independent claims. Dependent claims define some embodiments.

BRIEF DESCRIPTION DRAWINGS

Some example embodiments will be described with reference to the accompanying drawings, in which FIG. 1 illustrates an example of a marine vehicle;

DETAILED DESCRIPTION

The following embodiments are exemplary. Although the specification may refer to "an", "one", or "some" embodiment(s) in several locations, this does not necessarily mean that each such reference is to the same embodiment(s), or that the feature only applies to a single embodiment. Single features of different embodiments may also be combined to provide other embodiments. Furthermore, words "comprising" and "including" should be understood as not limiting the described embodiments/examples to consist of only those features that have been mentioned and such embodiments may contain also features/structures that have not been specifically mentioned. Further, although terms including ordinal numbers, such as "first", "second", etc., may be used for describing various elements, the structural elements are not restricted by the terms. The terms are used merely for the purpose of distinguishing an element from other elements. For example, a first element could be termed a second element, and similarly, a second element could be also termed a first element without departing from the scope of the present disclosure.

Embodiments and examples of the method described herein may be implemented in any foil wheel propulsion system with individually controllable foils.

It should be noted that while Figures illustrate various embodiments, they are simplified diagrams that only show some structures and/or functional entities. The connections shown in Figures may refer to logical or physical connections. It is apparent to a person skilled in the art that the described apparatus and/or system may also comprise other functions and structures than those described in Figures and text. It should be appreciated that details of some functions, structures, and the signalling used for measurement and/or controlling are irrelevant to the actual invention. Therefore, they need not be discussed in more detail here.

Figure 1:
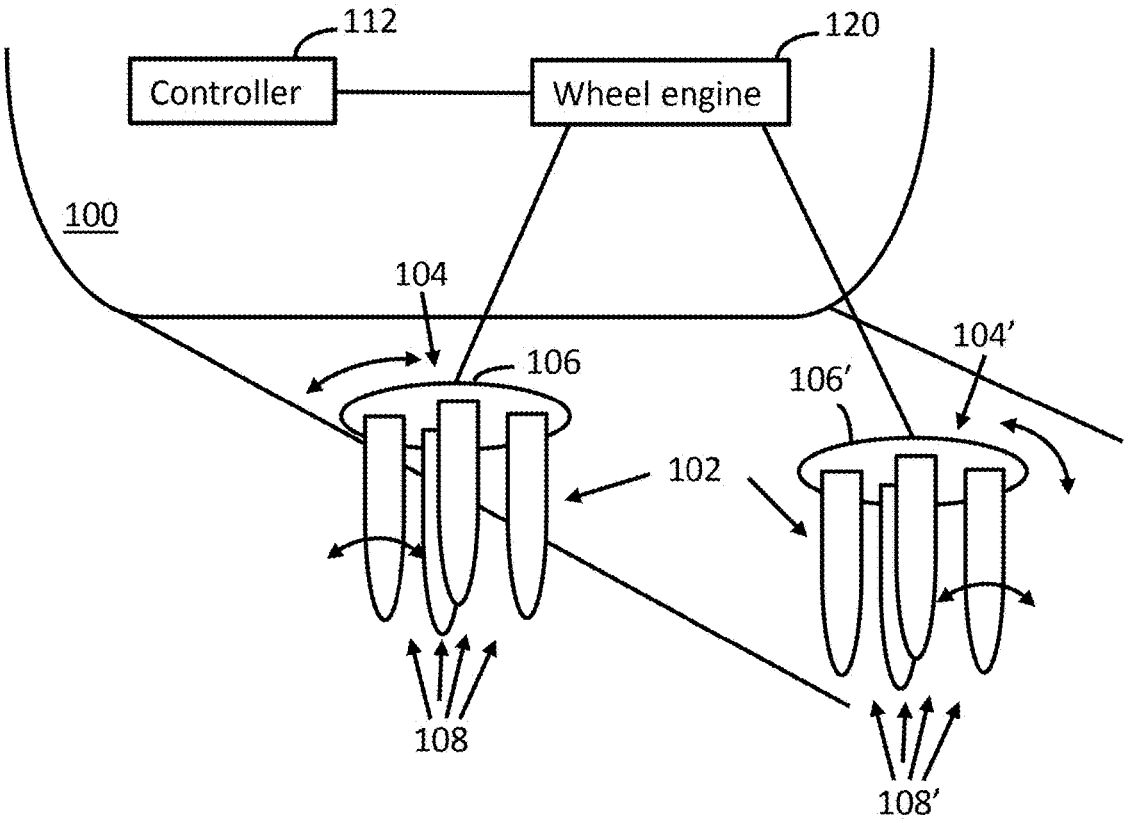

FIG. 1 illustrates an example of a marine vehicle 100 (the marine vehicle is partly shown in FIG. 1) with a propulsion system 102, which comprises one or more propulsion sub-systems 104, 104'. Marine vehicles may include transport vessels and passenger ships, and the term marine vehicle or marine vessel may generally refer to any craft designed for water transportation, for example. The transport ships may include cargo vessels and containers, for example. Additionally, the marine vehicles may refer to fishing vessels, service craft like tugboats and supply vessels, and warships. Furthermore, the marine vehicles may be used as ferries and submarines. It is apparent to a person skilled in the art that the marine vehicle comprises any number of shown elements, other equipment, other functions, and other structures that are not illustrated. They, as well as the protocols used, are well known by persons skilled in the art and are irrelevant to the actual invention. Therefore, they need not to be discussed in more detail here.

In the illustrated example, the propulsion sub-system 104, 104' is a cyclorotor propeller that may be capable of producing both a cycloidal pitch angle and a trochoidal pitch angle depending on the propeller's advance ratio. The advance ratio may be understood as the ratio of freestream fluid speed to the propeller's tip speed. Each exemplary propulsion sub-system 104, 104' comprises a foil wheel 106, 106'. The foil wheel 106, 106' comprises at least two foils 108, 108'. A foil 108, 108' is a blade that may extend from the wheel 106, 106' perpendicularly with respect to the rotational plane of the wheel 106, 106'. The foils 108, 108' are attached with the foil wheel 106, 106' in a rotatable manner. All the foils 108, 108' of the foil wheel 106, 106' may be individually controllable in a rotatable manner with respect to the foil wheel 106, 106' such that a desirable pitch angle can be obtained fully independently for each of the foils 108, 108'. Alternatively, the foils 108, 108' may be jointly controllable and coupled to the foil wheel, e.g., mechanically through suitable joints and/or gears, such that the desirable pitch angle may be obtained for each of the foils 108, 108'. For example, the foils 108, 108' may be coupled to achieve a constant phase difference between the rotation of individual foils.

As illustrated in the example of FIG. 1, a wheel engine system 120 may be common to a plurality of the propulsion sub-systems 104, 104' through a mechanical power transmission. Alternatively, each or some of the propulsion sub-systems 104, 104' may have a separate wheel engine system 120.

Figure 2:
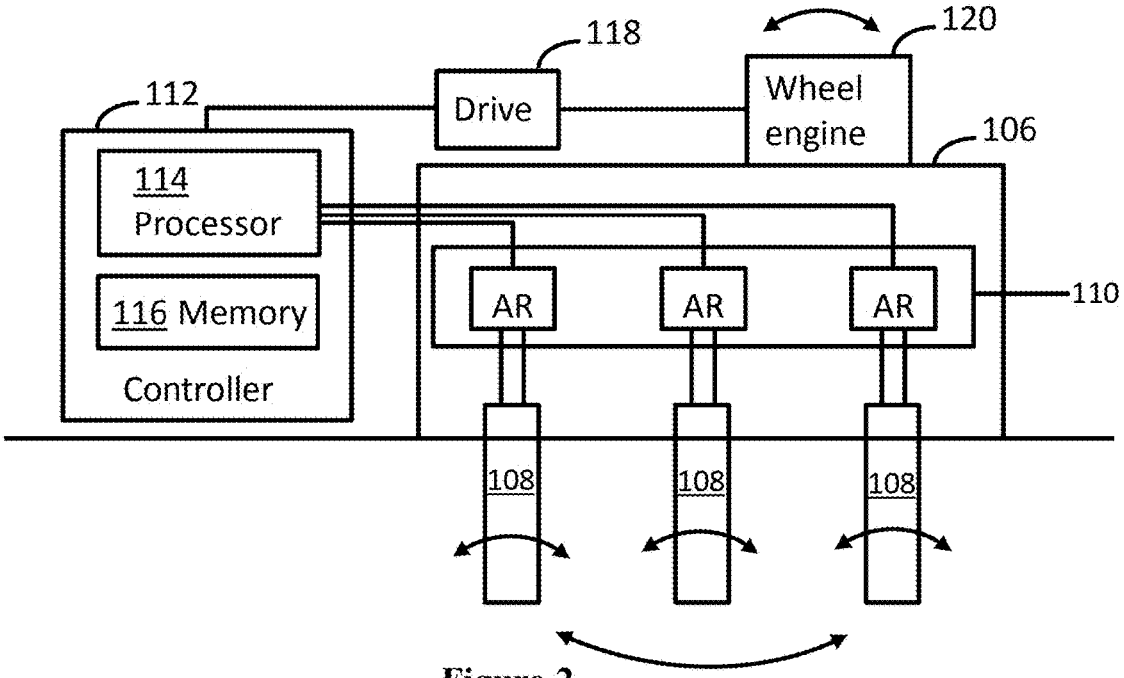
FIG. 2 illustrates an example of a propulsion system.

FIG. 2 illustrates an example where the propulsion system 102 comprises one foil wheel 106 with individually controllable foils 108. That is, the propulsion system 102 may correspond to one of the propulsion sub-systems 104, 104'. Additionally, the exemplary propulsion system 102 comprises an actuator arrangement 110 and a controller 112. The actuator arrangement 110 is operably coupled to the foils 108 and is configured to rotate the foils. The controller 112 may be common to the propulsion sub-systems 104, 104' (see FIG. 1) or the controller 112 may comprise a plurality of sub-controllers, a sub-controller per propulsion sub-system 104, 104' (such a possibility is illustrated in FIG. 2 although the controller 112 in FIG. 2 may also exist for the plurality of foil wheels).

According to an embodiment, the controller 112 comprises one or more processors 114 and one or more memories 116 including computer program code. The one or more memories 116 and the computer program code cause the controller 112, with the one or more processors 114, to form data on pitch angles $\gamma(\theta, r^+)$ of the at least two foils 108 based on an angle $\theta$ of rotation of the foil wheel 106, to which the at least two foils 108 are mechanically connected, and an angularly variable eccentricity $r^+$ of each of the at least two foils 108. This may be mathematically expressed as: $\gamma(\theta, r^+)=J(\theta, r^+(\theta))$, where J is a function or an operation that models the pitch angles $\gamma(\theta, r^+)$ of the at least two foils 108, and the angle $\theta$ of a rotation of the foil wheel 106 and the angularly variable eccentricity $r^+(\theta)$ are its arguments. The pitch angle $\gamma(\theta, r^+)$ of a foil may also be called a foil pitch trajectory because it is a function of the rotation angle $\theta$ of the foil wheel and it typically forms a curve. The angularly variable eccentricity $r^+$ is limited at a portion of the angle of rotation of the foil wheel 106 to limit a peak torque of the foil 108.

According to an embodiment, the controller 112 then communicates the data on the pitch angles $\gamma(\theta, r^+)$ to the actuator arrangement 110, which sets the at least two foils 108 at the pitch angles $\gamma(\theta, r^+)$ based on the data formed by the controller 112. The data may include parameters for the pitch angles and/or at least one value for the pitch angles. The actuator arrangement 110 may comprise an electric motor arrangement AR for each of the at least two foils 108, wherein the electric motor arrangement AR is operably coupled to the respective foil 108. The electric motor arrangement AR may be configured to rotate the respective foil 108 around the foil's longitudinal axis as illustrated in the example of FIG. 2. The electric motor arrangement AR may comprise a regulator and an electric motor (foil motor), which turns the foil it is mechanically coupled with according to the pitch angle $\gamma(\theta, r^+)$ from the controller 112, for example. Functionalities of the foil wheel 106 and the at least two foils 108 explained with FIG. 2 may correspondingly be also applied to the foil wheel 106' and foils 108' in FIG. 1.

The controller 112 may also control a drive 118 of a wheel engine system 120. The wheel engine system 120 may comprise an engine (motor), which may comprise an electric engine, a combustion engine such as, for example, a diesel engine, petrol engine, or a gas engine, and potentially a mechanical gearbox. The configuration of the drive 118 may depend on the type of the engine. If the wheel engine system 120 comprises one or more electric engines (electric motors), the drive 118 may comprise an electric drive configured to control the electric engine(s), for example. The controller 112 may send a command to the drive 118 which may then control a rotation speed and/or a direction of rotation of the engine of the wheel engine system 120. The wheel engine system 120 can rotate the foil wheel 106 directly or through the gearbox, for example. However, the details of the wheel engine system are irrelevant to the actual invention and a person skilled in the art is familiar with various wheel engine systems 120, per se. Therefore, they need not be discussed in more detail here. As illustrated in the example of FIG. 2, each of the propulsion sub-systems 104, 104' may have its own wheel engine system 120.

Figure 3:
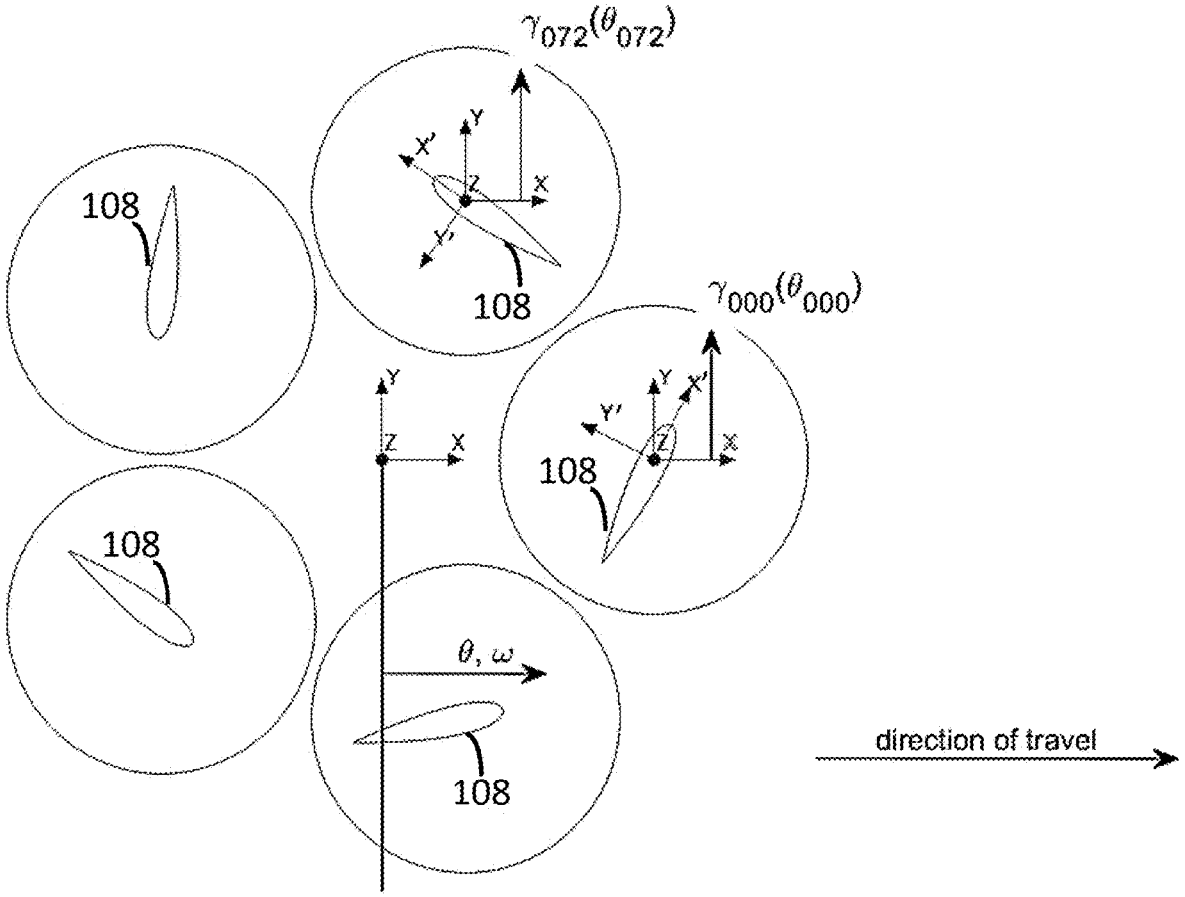
FIG. 3 illustrates an example of coordinate systems.

In an embodiment, the pitch angle may be written as $$\gamma = \tan^{-1}\left(\frac{\sin\theta}{r^+ + \cos\theta}\right),$$

where $\gamma$ is the foil pitch angle relative to x-axis (the current direction of travel), $\theta$ is the angle of rotation of the foil wheel 106 measured counterclockwise relative to the negative y-axis, $r^+$ is the eccentricity, and $\tan^{-1}$ is an inverse tangent function (also known as arcus tangent function). An example of coordinate systems and central angle definitions of the foils 108 is illustrated in FIG. 3, where X and Y denote the coordinate axes of the foil wheel with respect to the direction of travel, and X' and Y' denote the coordinate axes of the foils with respect to the foil wheel. Five foils 108 arranged with equal angles of 72° between adjacent foils are attached to the foil wheel (not shown in FIG. 3). An angular speed of the foil motor may then be written as $$\omega_{foil} = \frac{d\gamma}{d\theta}\omega_{wheel} - \omega_{wheel},$$

where $\omega_{wheel}$ is the angular speed of the foil wheel 106. An angular acceleration of the foil motor may be written as $$\alpha_{foil} = \frac{d^2\gamma}{d\theta^2}\omega_{wheel}^2,$$

where it is assumed that the angular speed $\omega_{wheel}$ of the foil wheel 106 is constant. Hence, behaviour of the first derivative and the second derivative of the pitch angle $\gamma$ determines behaviour of the angular speed and the angular acceleration of the foil motor, respectively. The required foil motor torque is dependent on the angular speed for hydro loads and on the angular acceleration for inertial loads. The angular speed and the angular acceleration peak around the angle $\theta=180°$ relative to the negative y-axis, and therefore the foils experience highest loads around that angle.

The angularly variable eccentricity $r_{lim}^+$ for limited torque is also a function of the rotation angle $\theta$. In an example, it may be written as $$r_{lim}^+ = r_{unlim}^+ - A\left(\sin^n\left(\frac{\theta}{2}\right)\right),$$

where $r_{unlim}^+$ is an optimum constant eccentricity obtainable with unlimited foil motor torque, A is a limitation amplitude parameter, and n is a steepness parameter. The limitation amplitude parameter and the steepness parameter define lower values for the eccentricity for the portion of the angle of rotation around a first angle of rotation where the foil 108 experiences a highest load. The first angle of rotation may be the angle $\theta=180°$ relative to the negative y-axis. The limitation amplitude parameter and the steepness parameter may be chosen as desired. The limitation amplitude defines how much the eccentricity is diminished from an eccentricity used outside the portion around the angle θ=180°. A large steepness parameter produces a narrow (in terms of θ) limitation portion while a smaller steepness parameter produces a wider limitation portion.

In another example, the angularly variable eccentricity $r_{lim}^{+}$ for limited torque may be written as a function that is symbolically different, for example, a partial sum of a Fourier series.

Figure 4:
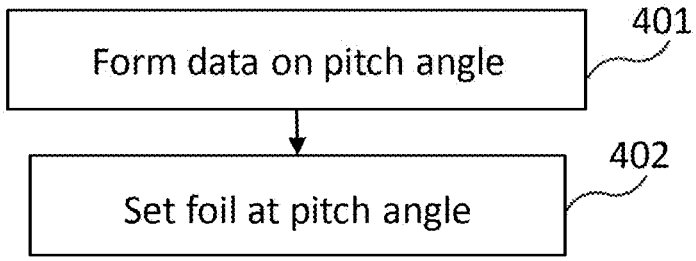
FIGS. 4 and 5 are flow charts illustrating example functionalities.

FIG. 4 illustrates an example of the controlling method.

Referring to FIG. 4, data on pitch angles of at least two foils are formed in block 401 by a controller, based on at least an angularly variable eccentricity of each of the at least two foils and an angle of rotation of a foil wheel. The at least two foils are individually controllable and in a rotatable manner attached with the foil wheel. The variable eccentricity is limited at a portion of the angle of rotation of the foil wheel. The at least two foils are set in block 402 at the pitch angles based on the data, by an actuator arrangement that received the data from the controller.

Figure 5:
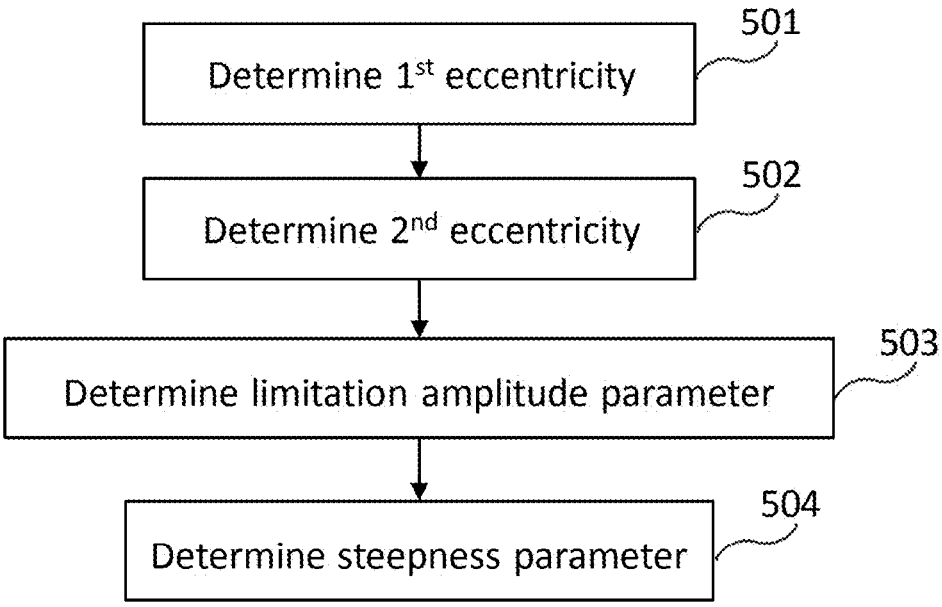

FIG. 5 illustrates an example of determining parameters for the angularly variable eccentricity of the controlling method.

Referring to FIG. 5, a first eccentricity is determined in block 501. The first eccentricity is an optimum constant eccentricity for unlimited torque. A second eccentricity is determined in block 502. The second eccentricity is a maximum constant eccentricity that may be endured by the foil motor. The limitation amplitude parameter is determined in block 503 as a deviation between the first eccentricity and the second eccentricity. For example, if the first eccentricity is 0.7 and the second eccentricity is 0.5, the limitation amplitude parameter is 0.2. Thus, the limitation amplitude parameter is a positive constant. The steepness parameter is determined on block 504 such that a first derivative and a second derivative of the data on the pitch angles with respect to the angle of rotation are smooth. The steepness parameter may be determined by iteration. The steepness parameter may also be determined by a more sophisticated optimization method.

Figure 6:
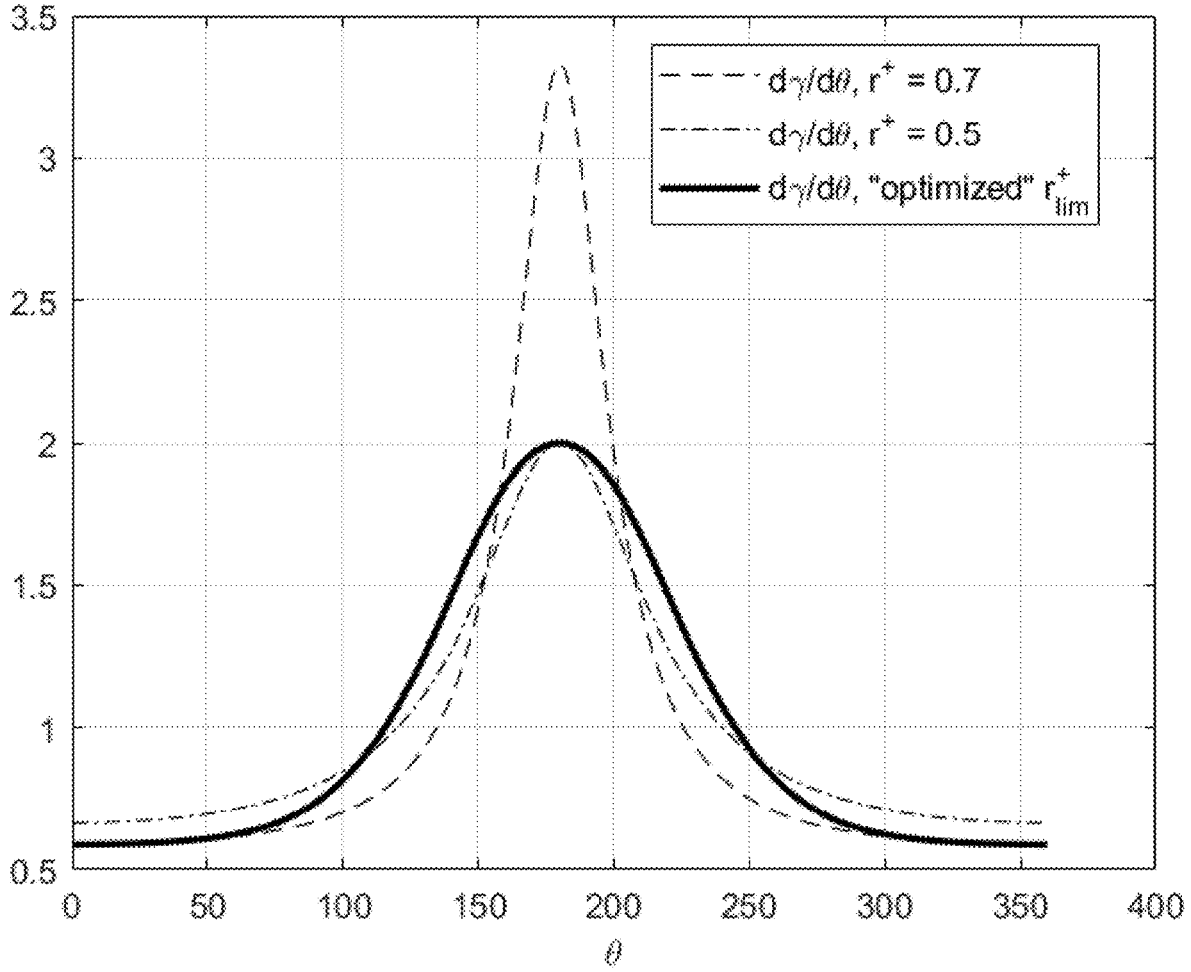
FIGS. 6 and 7 illustrate examples of pitch angle derivatives.
Figure 7:
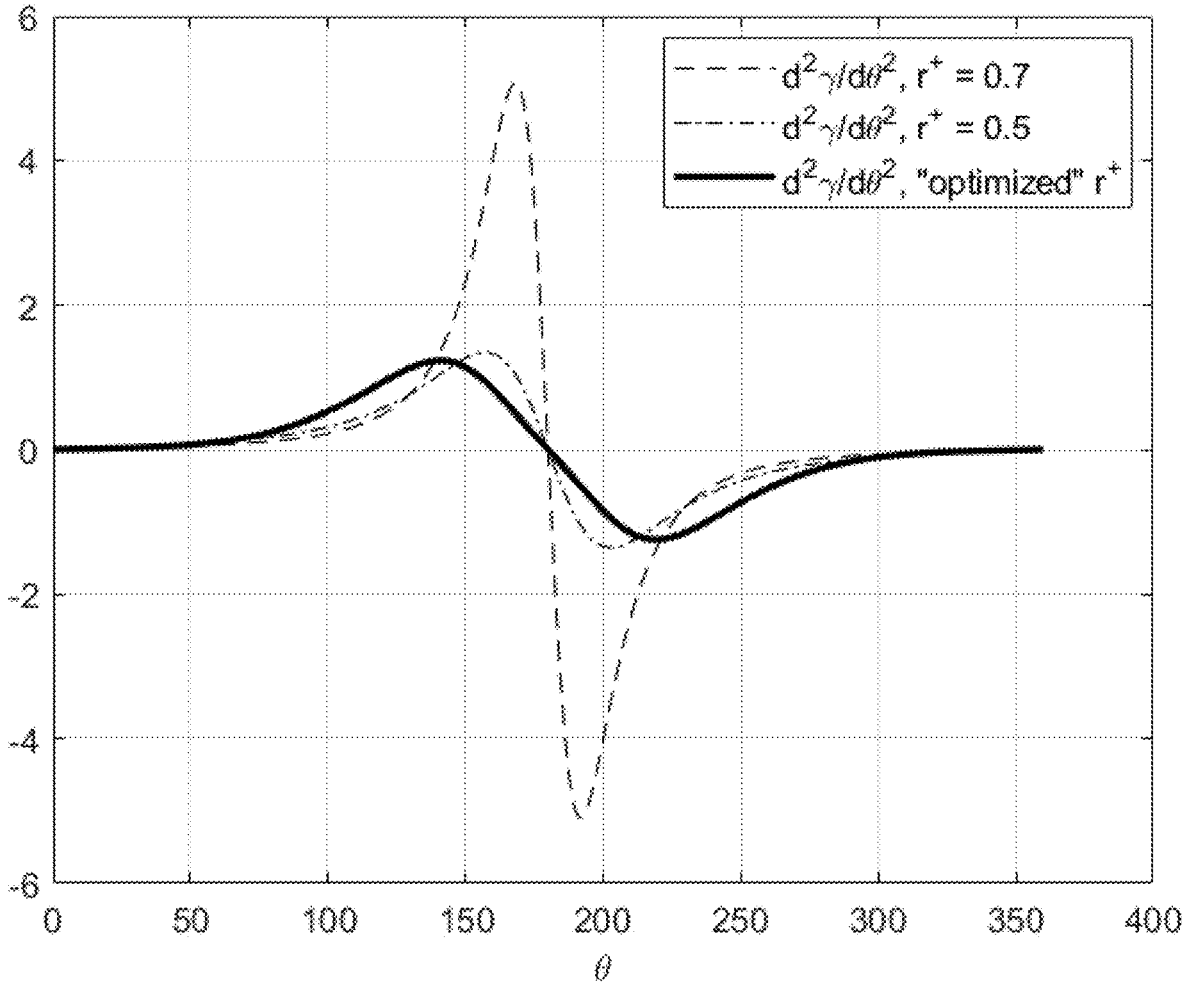

An example of the first derivatives is presented in FIG. 6 and an example of the second derivatives is presented in FIG. 7. The first derivative and the second derivative of the limited torque eccentricity pitch function are compared to the first and second derivatives of the constant eccentricity pitch functions.

Referring to FIGS. 6 and 7, dashed lines represent constant eccentricity $r^{+}=0.7$, dash-dot lines represent constant eccentricity $r^{+}=0.5$, and solid lines represent the torque limited eccentricity $$r_{lim}^{+} = 0.7 - 0.2\ \sin^6\left(\frac{\theta}{2}\right).$$

The numerical values in FIGS. 6 and 7 are just an example to show that the first and second derivatives related to the limited torque eccentricity may be steered close to the curves obtained by the constant eccentricity 0.7 for a large portion of the angle of rotation θ but around θ=180° the curves can be shifted closer to the curves obtained by the constant eccentricity 0.5 to avoid the high load to the foil motor.

Figure 8:
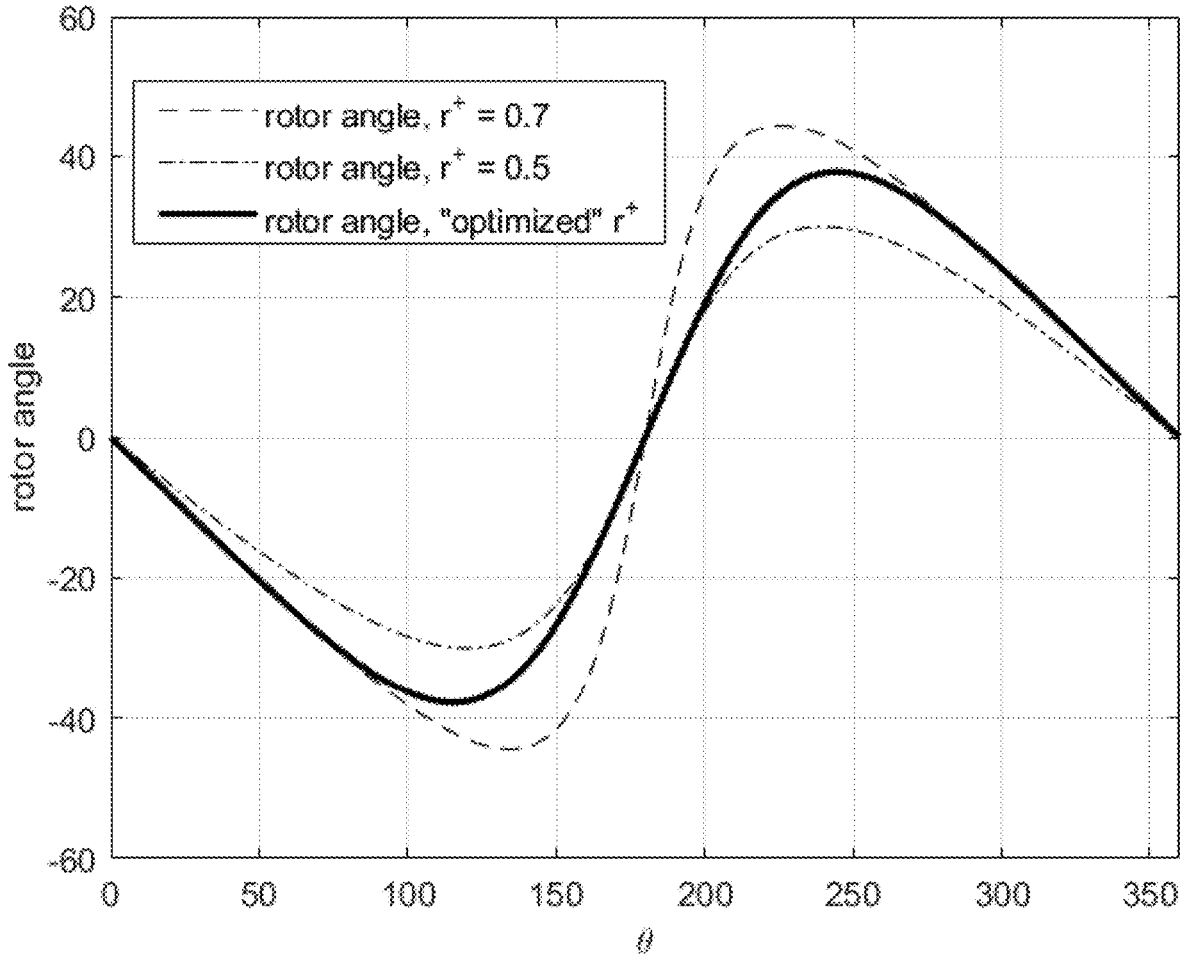
FIG. 8 illustrates an example of foil motor rotor angle curves.

FIG. 8 illustrates a corresponding example of the foil motor rotor angle relative to the stator, which can be determined by subtracting the angle of rotation θ from the pitch angle γ, that is, γ-θ. Dashed line represents constant eccentricity $r^{+}=0.7$, dash-dot line represents constant eccentricity $r^{+}=0.5$, and solid line represents the torque limited eccentricity $$r_{lim}^{+} = 0.7 - 0.2\ \sin^6\left(\frac{\theta}{2}\right).$$

The numerical values in FIG. 8 are just an example to show that the rotor angle related to the limited torque eccentricity may be steered close to the curves obtained by the constant eccentricity 0.7 for a large portion of the angle of rotation θ but around θ=180° the curves can be shifted closer to the curves obtained by the constant eccentricity 0.5 to avoid the high load to the foil motor.

An advantage of the formation of the pitch angle of the foil trajectory as a function of the angularly variable eccentricity may be gaining a higher bollard pull thrust while the maximum foil motor torque may be even somewhat decreased. Foil-wise eccentricity adjustment is enabled by the individually controllable foils. The presented method may be used to optimize the pitch function to be appropriate for a chosen foil motor torque specification, or to choose foil motors for a required bollard pull thrust without over-dimensioning them.

An example of a foil wheel bollard pull performance simulation is presented in Table 1. A speed of 55 RPM is used in the simulation. If the constant eccentricity $r^{+}=0.5$ is considered to be at the foil motor torque limit, that is, bollard pull thrust cannot be increased by increasing the constant eccentricity, changing to the angularly variable torque limited eccentricity $r_{lim}^{+}$ may give a 33% higher bollard pull thrust while the maximum foil motor torque decreases from 61 kNm to 56 kNm.

TABLE 1

| $r^{+}$ | Power [kW] | Thrust [kN] | Foil motor Mz, max [kNm] |
|---|---|---|---|
| 0.7 | 3006 | 406 | 190 |
| 0.5 | 1500 | 244 | 61 |
| torque limited | 2084 | 324 | 56 |

Figure 9:
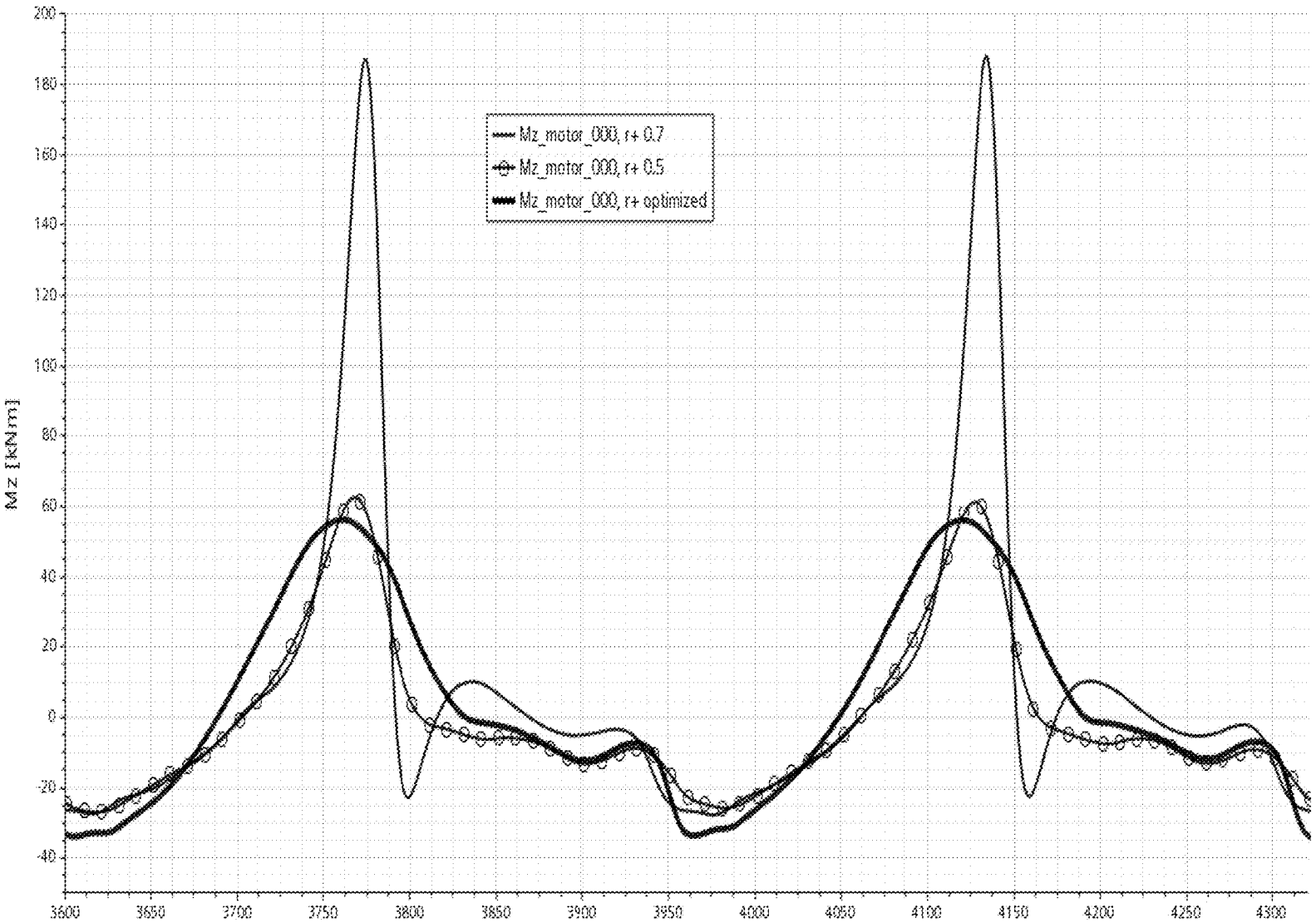
FIG. 9 illustrates an example of foil motor torque curves.

FIG. 9 illustrates a corresponding example of the resulting foil motor torques. Thinner solid line represents constant eccentricity $r^{+}=0.7$, solid-circle line represents constant eccentricity $r^{+}=0.5$, and thicker solid line represents the torque limited eccentricity $$r_{lim}^{+} = 0.7 - 0.2\ \sin^6\left(\frac{\theta}{2}\right).$$

The numerical values in FIG. 9 are just an example to show that the maximum foil motor torque related to the limited torque eccentricity is even smaller than the torque obtained by the constant eccentricity 0.5.

The blocks and related functions described above in FIGS. 4 and 5 are in no absolute chronological order, and some of the blocks may be performed simultaneously or in an order differing from the given one. Other functions can also be executed between the blocks or within the blocks. Some of the blocks or part of the blocks can also be left out or replaced by a corresponding block or part of a block, for example, determining the first eccentricity and the second eccentricity, can be left out or replaced with each other.

The techniques described herein may be implemented by various means so that an apparatus implementing one or more functions/operations described above with an embodiment/example, for example by means of any of FIGS. 1 to 5 and any combination thereof, comprises not only prior art means, but also means for implementing the one or more functions/operations of a corresponding functionality described with an embodiment, for example by means of any of FIGS. 1 to 5 and any combination thereof, and it may comprise separate means for each separate function/operation, or means may be configured to perform two or more functions/operations. For example, one or more of the means for one or more functions/operations described above may be software and/or software-hardware and/or hardware and/or firmware components (recorded indelibly on a medium such as read-only-memory or embodied in hard-wired computer circuitry) or combinations thereof. Software codes may be stored in any suitable, processor/computer-readable data storage medium(s) or memory unit(s) or article(s) of manufacture and executed by one or more processors/computers, hardware (one or more apparatuses), firmware (one or more apparatuses), software (one or more modules), or combinations thereof. For a firmware or a software, implementation can be through modules (for example procedures, functions, and so on) that perform the functions described herein.

Figure 10:
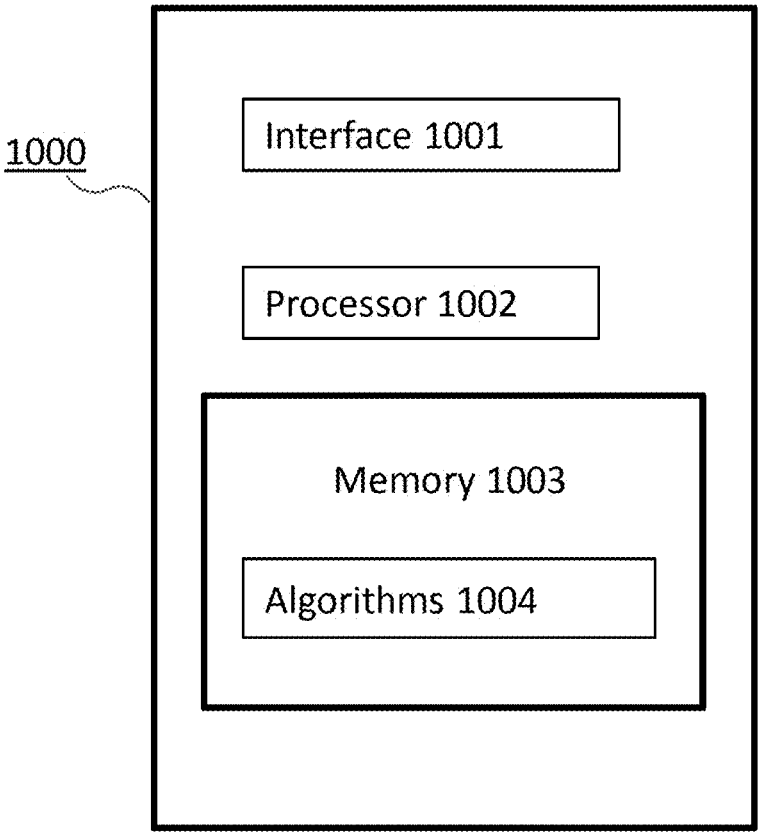
FIG. 10 illustrates an exemplary embodiment of an apparatus.

FIG. 10 is a simplified block diagram illustrating some units for an apparatus (device, equipment) 1000 configured to perform at least some functionality described above for controlling the propulsion of a marine vehicle, for example by means of FIGS. 1 to 5 and any combination thereof. In the illustrated example, the apparatus 1000 comprises one or more interface (IF) entities 1001, such as one or more user interfaces, and one or more processing entities 1002 connected to various interface entities 1001 and to one or more memories 1003.

The one or more interface entities 1001 are entities for receiving and transmitting information, such as communication interfaces comprising hardware and/or software for realising communication connectivity according to one or more communication protocols, or for realising data storing and fetching, or for providing user interaction via one or more user interfaces as described above in the explanation of the example illustrated by FIG. 1.

A processing entity 1002 is capable to perform calculations and configured to implement at least part of functionalities/operations described above, for example by means of any of FIGS. 1 to 5 and any combination thereof, with corresponding algorithms 1004 stored in the memory 1003. The entity 1002 may include one or more processors, controllers, control units, micro-controllers, etc. configurable to carry out embodiments/examples/implementations or operations described above, for example by means of any of FIGS. 1 to 5 and any combination thereof. Generally, a processor is a central processing unit, but the processor entity 1002 may be an additional operation processor or a multicore processor or a microprocessor.

A memory 1003 is usable for storing a computer program code required for one or more functionalities/operations described above, for example by means of any of FIGS. 1 to 5 and any combination thereof, that is, the algorithms 1004 for implementing the functionality/operations described above by means of any of FIGS. 1 to 5 and any combination thereof. The memory 1003 may also be usable for storing, at least temporarily, other possible information required for one or more functionalities/operations described above, for example by means of any of FIGS. 1 to 5 and any combination thereof. The memory 1003 may comprise a data buffer that may, at least temporarily, store for example measurement data and/or information received as a user input.

As a summary, the methods described herein, for example by means of any of FIGS. 1 to 5 and any combination thereof, may be configured as a computer or a processor, or a microprocessor, such as a single-chip computer element, or as a chipset, or one or more logic gates including at least a memory for providing storage area used for arithmetic operation and an operation processor for executing the arithmetic operation. Each or some or one of the algorithms for functions/operations described above, for example by means of any of FIGS. 1 to 5 and any combination thereof, may be comprised in one or more computer processors, application-specific integrated circuits (ASIC), digital signal processors (DSP), digital signal processing devices (DSPD), programmable logic devices (PLD), field-programmable gate arrays (FPGA), graphics processing units (GPU) and/or other hardware components that have been programmed and/or will be programmed by downloading computer program code (one or more algorithms) in such a way to carry out one or more functions of one or more embodiments/examples.

An embodiment provides a computer program embodied on any client-readable distribution/data storage medium or memory unit(s) or article(s) of manufacture, comprising program instructions executable by one or more processors/computers, which instructions, when loaded into an apparatus (device, equipment), constitute an entity providing corresponding functionality, or at least part of the corresponding functionality. Programs, also called program products, including software routines, program snippets constituting "program libraries", applets, and macros, can be stored in any medium, including non-transitory computer readable storage medium, and may be downloaded into an apparatus. In other words, each or some or one of the algorithms for one or more functions/operations described above, for example by means of any of FIGS. 1 to 5 and any combination thereof, may be comprised in an element that comprises one or more arithmetic logic units, a number of special registers and control circuits.

It will be obvious to a person skilled in the art that, as the technology advances, the inventive concept can be implemented in various ways. The invention and its embodiments are not limited to the examples described above but may vary within the scope of the claims.

The invention claimed is:

1. A method for controlling a propulsion system of a marine vehicle, the propulsion system having a foil wheel, at least two foils attached with the foil wheel in a rotatable manner, an actuator arrangement, and a controller, the method comprising:

forming, by the controller, data on pitch angles of the at least two foils based on at least an angularly variable eccentricity of the at least two foils and an angle of rotation of the foil wheel, wherein the variable eccentricity is limited at a portion of the angle of rotation of the foil wheel; and setting, by the actuator arrangement receiving the data from the controller, the at least two foils at the pitch angles based on the data.

2. The method of claim 1, wherein at least two foils are individually controllable.

3. The method of claim 1, wherein the portion of the angle of rotation of the foil wheel is located around a first angle of rotation, wherein a foil experiences a highest load at the first angle of rotation.

4. The method of claim 1, further comprising:

determining the portion of the angle of rotation of the foil wheel using at least a limitation amplitude parameter and a steepness parameter.

5. The method of claim 4, further comprising:

determining a first eccentricity, wherein the first eccentricity is an optimum constant eccentricity for unlimited foil motor torque;

determining a second eccentricity, wherein the second eccentricity is a maximum constant eccentricity endured by the foil;

determining the limitation amplitude parameter as a deviation be-tween the first eccentricity and the second eccentricity; and determining the steepness parameter such that a first derivative and a second derivative of the data on the pitch angles with respect to the angle of rotation are smooth.

6. The method of claim 1, further comprising:

determining the portion of the angle of rotation of the foil wheel using parameters of a Fourier series.

7. A non-transitory computer-readable medium comprising program instructions which, when run by an apparatus controlling a propulsion system of a marine vehicle, the propulsion system including a foil wheel, at least two foils attached with the foil wheel in a rotatable manner, an actuator arrangement, and a controller, cause the apparatus at least to:

form, by the controller, data on pitch angles of the at least two foils based on at least an angularly variable eccentricity of the at least two foils and an angle of rotation of the foil wheel, wherein the variable eccentricity is limited at a portion of the angle of rotation of the foil wheel; and set, by the actuator arrangement receiving the data from the controller, at least two foils at the pitch angles based on the data.

8. The computer-readable medium of claim 7, wherein the portion of the angle of rotation of the foil wheel is located around a first angle of rotation, wherein a foil experiences a highest load at the first angle of rotation.

9. A propulsion system for a marine vehicle, comprising:

a foil wheel;

at least two foils, which are in a rotatable manner attached with the foil wheel;

an actuator arrangement; and a controller, the controller having one or more processors and one or more memories including computer program code, wherein the one or more memories and the computer program code are configured to, with the one or more processors, cause at least the controller to form data on pitch angles of the at least two foils based on at least an angularly variable eccentricity of the at least two foils and an angle of rotation of the foil wheel, wherein the variable eccentricity is limited at a portion of the angle of rotation of the foil wheel, and to communicate the data on the pitch angles to the actuator arrangement, and wherein the actuator arrangement is configured to set the at least two foils at the pitch angles based on the data.

10. The propulsion system of claim 9, wherein the at least two foils are individually controllable.

11. The propulsion system of claim 9, wherein the portion of the angle of rotation of the foil wheel is located around a first angle of rotation, wherein a foil experiences a highest load at the first angle of rotation.

12. The propulsion system of claim 9, wherein the one or more memories and the computer program code are configured to, with the one or more processors, further cause the controller to determine the portion of the angle of rotation of the foil wheel using at least a limitation amplitude parameter and a steepness parameter.

13. The propulsion system of claim 12, wherein the one or more memories and the computer program code are configured to, with the one or more processors, further cause the controller to:

determine a first eccentricity, wherein the first eccentricity is an optimum constant eccentricity for unlimited foil motor torque;

determine a second eccentricity, wherein the second eccentricity is a maximum constant eccentricity endured by the foil;

determine the limitation amplitude parameter as a deviation between the first eccentricity and the second eccentricity; and determine the steepness parameter such that a first derivative and a second derivative of the data on the pitch angles with respect to the angle of rotation are smooth.

14. The propulsion system of claim 9, wherein the one or more memories and the computer program code are configured to, with the one or more processors, further cause the controller to determine the portion of the angle of rotation of the foil wheel using parameters of a Fourier series.

15. A marine vehicle, comprising at least one propulsion system comprising a foil wheel, at least two foils attached with the foil wheel in a rotatable manner, an actuator arrangement, and a controller, wherein the controller of the propulsion system is configured to form data on pitch angles of the at least two foils based on at least an angularly variable eccentricity of the at least two foils and an angle of rotation of the foil wheel, wherein the variable eccentricity is limited at a portion of the angle of rotation of the foil wheel, and wherein the actuator arrangement is configured to set the at least two foils at the pitch angles based on the data formed by the controller.

16. The marine vehicle of claim 15, wherein at least two foils are configured to be individually controllable.

17. The marine vehicle of claim 15, wherein said portion of the angle of rotation of the foil wheel is located around a first angle of rotation, wherein a foil experiences a highest load at the first angle of rotation.

18. The marine vehicle of claim 15, wherein the controller is further configured to determine said portion of the angle of rotation of the foil wheel using at least a limitation amplitude parameter and a steepness parameter.

19. The marine vehicle of claim 18, wherein the controller is further configured to:

determine a first eccentricity, wherein the first eccentricity is an optimum constant eccentricity for unlimited foil motor torque;

determine a second eccentricity, wherein the second eccentricity is a maximum constant eccentricity endured by the foil;

determine the limitation amplitude parameter as a deviation be-tween the first eccentricity and the second eccentricity; and determine the steepness parameter such that a first derivative and a second derivative of the data on the pitch angles with respect to the angle of rotation are smooth.

20. The marine vehicle of claim 15, wherein the controller is further configured to determine said portion of the angle of rotation of the foil wheel using parameters of a Fourier series.

* * * * *